United States Patent [19]

Hasker et al.

[11] Patent Number: 4,471,260

[45] Date of Patent: Sep. 11, 1984

[54] OXIDE CATHODE

[75] Inventors: Jan Hasker; Jacobus H. Jacobs; Peter Opmeer; Johannes A. T. Verhoeven, all of Eindhoven, Netherlands

[73] Assignee: U.S. Philips Corporation, New York, N.Y.

[21] Appl. No.: 340,553

[22] Filed: Jan. 18, 1982

[30] Foreign Application Priority Data

Feb. 26, 1981 [NL] Netherlands ..... 8100928

[51] Int. Cl.[3] ..... H01J 1/14; H01J 19/06; H01K 1/04

[52] U.S. Cl. ..... 313/346 R; 313/341; 313/345

[58] Field of Search ..... 313/341, 345, 346, 355

[56] References Cited

U.S. PATENT DOCUMENTS

| | | | |
|---|---|---|---|
| 4,215,180 | 7/1980 | Misumi et al. | 313/341 |
| 4,302,702 | 11/1981 | Montgaillard et al. | 313/299 |
| 4,313,854 | 2/1982 | Sunahara et al. | 313/346 |

*Primary Examiner*—John D. Lee
*Assistant Examiner*—Robert E. Wise
*Attorney, Agent, or Firm*—Robert J. Kraus

[57] ABSTRACT

An oxide cathode comprising a metal base substantially consisting of titanium and a heating element for heating said base, on which base a porous layer comprising an alkaline earth metal oxide is provided. The cathode has a comparatively low operating temperature, a short warm up time and a low power requirement.

4 Claims, 7 Drawing Figures

OXIDE CATHODE

BACKGROUND OF THE INVENTION

The invention relates to an oxide cathode comprising a metal base and a heating element for heating said base, on which base a porous layer comprising an alkaline earth metal oxide is provided.

Such oxide cathodes are used in cathode ray tubes, for example display tubes for monochromatic and colour display of television pictures, camera tubes, storage tubes and oscillograph tubes.

Such an oxide cathode for a cathode ray tube is known inter alia from the article "Chemical Transport in Oxide Cathodes" Philips Res. Repts 26, 519–531, 1971. The oxide cathode described therein is a cathode of the so-called indirectly heated type which is composed of a base of polycrystalline nickel on which on one side a porous layer of alkaline earth metal oxides is provided. The other side is radiated by a heating element. The oxide layer generally has the composition $$Ba_xSr_{1-x}O$$

with x approximately equal to 0.5. The thickness of the layer is approximately 50 μm and the density of the layer is approximately 0.7. The base comprises an activator, for example Mg, either in a solid solution or in regularly divided grains. Mainly BaO is reduced to Ba by said activator so as to obtain good emission properties which are characteristic of Ba on SrO. In this process, a diffusion along grain boundaries in the material of the base plays an important role.

An advantage of such an oxide cathode is the comparatively low operating temperature of approximately 800° C. In television display tubes undesired grid emission is kept small by said comparatively low temperature. In camera tubes having a so-called diode electron gun the beam-discharge lag will be low due to said comparatively low temperature. Moreover, at such a low operating temperature, the power to be applied to the heating element will be smaller than in a cathode having a higher operating temperature. In order to avoid too large a Ba production and consequently evaporation of Ba at the beginning of the life of the cathode, the concentration of the activator in the nickel may be small. This means, however, that the base may not be too thin because in that case the activator would be exhausted too soon. Usually, therefore, the thickness is larger than 50 μm and preferably is approximately 100 μm. This puts a limit on the minimum warm-up time of the cathode. This is the time needed after switching on the voltage across the heating element for the cathode current to reach 10% of the steady state current supplied. In the case in which the operating temperature is 800° C., the cathode temperature at 10% of the emission at the operating temperature is approximately 600° C. For a 1.5 watt cathode used frequently in television display tubes the warm-up time is 5.5 seconds. Due to its comparatively large thickness together with the comparatively large specific heat and the comparatively large specific weight of the nickel, the base provides a considerable contribution to the overall heat capacity and hence to the warm-up time of said indirectly heated cathode. It is known that the warm-up time for directly heated cathodes may be considerably shorter than for the above-described indirectly heated cathode. A disadvantage of such directly heated cathodes is, for example, that cathode control cannot be used in a simple manner. Because the warm-up time is proportional to the quotient of the heat capacity and the stationary power supplied to the cathode, a smaller heat capacity of the base may be used to reduce the stationary power to be supplied if the warm-up time of the directly heated cathode is already sufficiently small. The base must go on fulfilling its BaO-reducing function for the required long life time and the adhesion of the porous oxide layer to the base must remain good.

SUMMARY OF THE INVENTION

It is therefore an object of the invention to provide an oxide cathode which has sufficient emission at an operating temperature lower than the usual operating temperature.

Another object of the invention is to provide an oxide cathode which has a more rapid warm-up time and/or which can operate with less power supplied to the heating element.

An oxide cathode of the kind mentioned in the opening paragraph is characterized according to the invention in that the base consists substantially of titanium (Ti).

The invention is based on the following recognition. In the reduction of BaO by Ti the oxygen disappears in the Ti lattice and no undesired compounds are formed at the surface which might give rise to adhesion problems between the porous layer and the base. The average zero field saturation emission over the cathode surface according to the Richardson-Dushman equation is $$J=AT^2e^{-e\phi/kT}$$

wherein

J is the current density

A is a constant dependent on the emissive material

T is the cathode temperature in °K.

k is Boltzmann's constant e is the elementary charge, and $\phi$ is the work function of the emissive material.

As a result of the above-mentioned reduction mechanism the emission is divided much more homogeneously over the surface than in a conventional oxide cathode. As a result of this the material constant A is approximately 10× as large for the last-mentioned cathodes. In addition because at 700° C. the barium production is at the level required for good emission and a long life, the operation temperature of a cathode having a base of Ti may be approximately 100° lower than the operating temperature of the conventional oxide cathodes on a nickel base.

It has also been found that when using Zr as a material for the base, the compromise between emission properties and Ba production is much less favourable. Moreover, adhesion problems occur when Zr is used.

On the basis of the above mentioned mechanism it is simple to see that as regards the life a thickness of the base of approximately 25 μm is amply sufficient. Moreover, the product of specific heat and specific weight for Ti is approximately a factor 2 smaller than for Ni. So compared with Ni the heat capacity of the base can be considerably reduced (approximately a factor 10) by using Ti.

The cathode according to the invention may be of the directly heated type or of the indirectly heated type. An indirectly heated cathode according to the invention may be constructed in the usual manner. The Ti base with the emissive layer is provided on a shank of another metal, within which the heating element is present. Base and shank may also form one assembly, for example, a thinwalled Ti bush with the heating element in the interior and the emissive layer on the outside on the end face of the Ti bush.

It is also possible to use a laminated structure in which the Ti base supporting the emissive layer is provided on one side of a thin insulating plate and the heating element is provided on the other side.

$Al_2O_3$ is usually used for the electric insulation between the heating element and the base. However, this is chemically unstable in contact with Ti so that during the life of the cathode insulation problems might occur. From the point of view of stability and other thermal and electrical properties, BeO is a very suitable insulation material. A disadvantage, however, is that it is very poisonous.

Another suitable insulation material is $Y_2O_3$ so that a first preferred embodiment of a cathode in accordance with the invention is characterized in that the heating element is electrically insulated from the base by means of a layer of yttrium oxide ($Y_2O_3$). Compared with $Al_2O_3$, said $Y_2O_3$ has the additional advantage of a thermal capacity which is approximately a factor two lower. Of course, in a cathode in accordance with the invention (on a Ti base) as a result of the inherently smaller thermal capacity said smaller thermal capacity of the $Y_2O_3$ insulation material is more important than when the conventionally used cathodes having a comparatively large thermal capacity are used.

A second preferred embodiment of a cathode in accordance with the invention is characterized in that the heating element consists of two substantially L-shaped thin metal bands each having a short and a long strip-shaped portion, which bands are secured to the base by the ends of the short strip-shaped portions with the longitudinal axes of the long strip-shaped portions extending substantially parallel to the surface of the base. The longitudinal axes enclose an angle with each other between 30° and 120°. The bands also serve for the suspension of the oxide cathode. The angle between the long strip-shaped portions is preferably between 30° and 120° for mechanical rigidity, a determined from experiments. In cathodes having a very low power (approximately 0.3 W) and a very short warm-up time (approximately 1 sec), however, it becomes difficult to satisfy the very stringent requirements with respect to the occurrence of microphony effects. Maintaining the low power and the short warm-up time is also possible by using a third preferred embodiment of a cathode in accordance with the invention, which is characterized in that the heating element consists of four thin metal bands extending from the base and, two of which serve to supply and two of which serve to carry off the electric current for the heating, said bands also serving for the suspension of the cathode. In an embodiment in which the suspension takes place without stretching the bands between connection points it is favourable for the mechanical rigidity when the base and the bands are not located in one plane.

BRIEF DESCRIPTION OF THE DRAWING

A few embodiments of cathodes according to the invention will now be described by way of example with reference to a drawing, in which.

DESCRIPTION OF THE PREFERRED EMBODIMENTS

Figure 1:
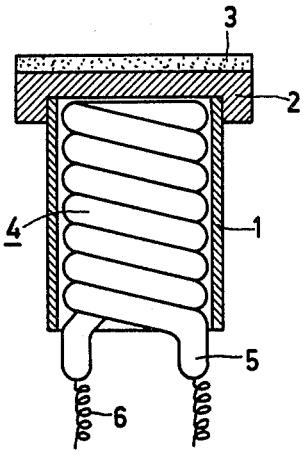
FIG.1 PRIOR ART
FIG. 1 is a sectional view of a prior art oxide cathode.

FIG. 1 is a sectional view of a prior art oxide cathode. This cathode consists of a blackened cathode shank 1 of Ni—Cr (80—20) having an outside diameter of 1.8 mm and a height of 2.2 mm. The thickness of the wall of said shank is 40 μm. The shank is closed with a cap 2 consisting of magnesium-activated nickel having in the centre a thickness of 0.1 mm, which cap serves as a base for the emissive layer 3 of BaO and SrO having a thickness of approximately 60 μm. A heating element 4 consisting of a wire 6 coated with a layer 5 of $Al_2O_3$ is provided in the cathode shank. At the normal operating temperature of the cathode the power supplied to the heating element is approximately 1.5 watt when said shank is connected to a cathode support as is usual by means of three Ni—Fe (50—50) bands (not shown) having a thickness of 0.06 mm and a width of 0.7 mm and a length of 2.2 mm. When said cathode is used in a colour television display tube (for example, the types 20-AX and 30-AX of Philips) the warm-up time is approximately 5.5 seconds.

Figure 2:
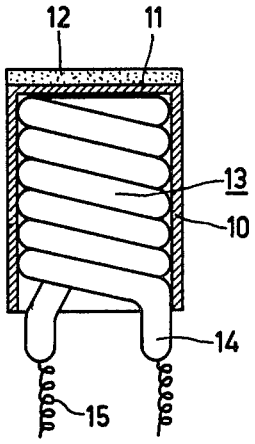
FIG. 2 is a sectional view of a similar indirectly heated oxide cathode according to the invention.

FIG. 2 is a sectional view of a similar indirectly heated cathode in accordance with the invention. This cathode is composed of a deep drawn bush 10 of Ti. Said bush 10 has the same dimensions as the shank used in the cathode shown in FIG. 1. The thickness of the material of the bush is approximately 40 μm. On the end face 11 and bush 10 which forms the base for the emissive material and which likewise has a thickness of approximately 40 μm, a layer 12 of BaO and SrO having a thickness of approximately 60 μm is provided. A heating element 13 consisting of W wire covered with a layer 14 of $Y_2O_3$ is provided in bush 10. Because the operating temperature of this cathode is approximately 100° lower than for the cathode shown in FIG. 1 and because the Ti cathode shank has not been blackened, the Ni—Fe (50—50) suspension bands must be replaced by Ta suspension bands of the same dimensions so as to obtain a power of approximately 1.5 watt supplied to the heating element. The warm-up time after switching on the current through the heating element then is approximately a factor 2 shorter than for the cathode described with reference to FIG. 1. The most significant impurities in the Ti of the above-described example and the following examples were 0.08% by weight Cr, 0.1% by weight Fe, 0.1% by weight Mo and 0.02% by weight Ni.

Figure 3:
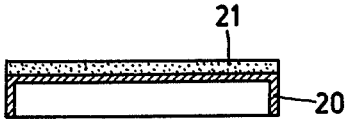
FIG. 3 is a sectional view of a directly heated oxide cathode in accordance with the invention.
Figure 4:
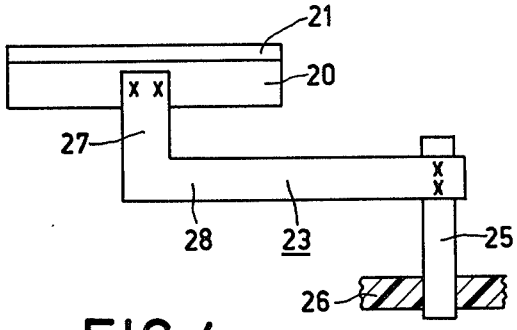
FIG. 4 is an elevation of a directly heated oxide cathode as shown in FIG. 3.
Figure 5:
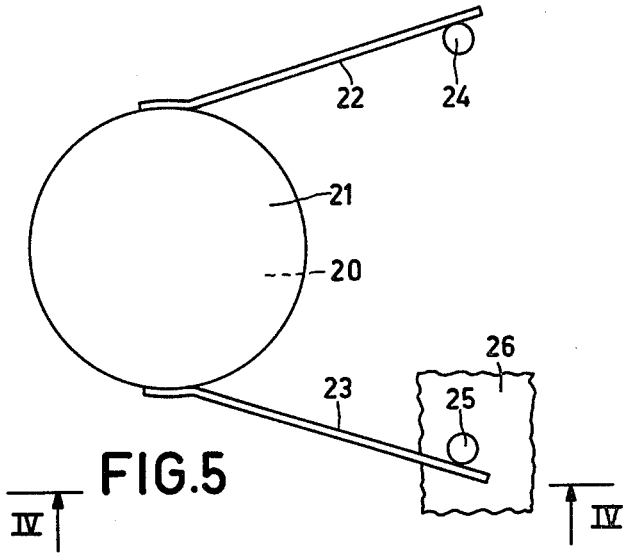
FIG. 5 is a plan view of the directly heated oxide cathode as shown in FIG. 3.

FIGS. 3, 4 and 5 are a sectional view, an elevation and a plan view, respectively, of a cathode of the directly heated type in accordance with the invention. The cathode base 20 which consists of Ti and which is shown in the cross-section of FIG. 3 is circular and has a diameter of 1.3 mm, a height of 0.2 mm, while the thickness of the base material is 25 μm. The thickness of the emissive layer 21 consisting of BaO and SrO is approximately 60 μm. As shown in FIGS. 4 and 5, L-shaped metal bands 22 and 23 are secured to the cathode base 20 and together constitute the heating element of the directly heated cathode. These metal bands have a short strip-shaped portion 27 and a long strip-shaped portion 28 and also form the suspension for the cathode. They are welded, for example to supporting pins 24 and 25 which in turn are secured in an insulating supporting ring 26 of ceramic material. The length of the L-shaped bands measured along the centre line is 3.9 mm; the width of the bands is 0.35 mm. As a result of the very small heat capacity of said base 20 and the layer 21, the bands play an important part with respect to the warm-up time and the power to be supplied. When Ta is used in a thickness of 25 μm for the L-shaped metal bands, the power required for the operating temperature of 700° C. is 0.34 W. The warm-up time of such a cathode is 1.2 seconds. Measurements have demonstrated that the cathode temperature was approximately 500° C. 1.2 seconds after switching on. In diodes having such a cathode the emission measured in a 500 V pulse was $5A/cm^2$ after activating the cathode. After 8000 hours space charge-limited continuous load of $0.6A/cm^2$ with constant anode voltage, the pulse emission was only approximately 10% lower than immediately after activating the cathode.

In a similar cathode having a base 20 of Ti and an emissive layer 21, this time with L-shaped bands of invar (with a small piece of Ta in the joint between the band and the Ti cap as a barrier between the Ti and the invar), the thickness of the bands must be 50 μm to obtain a power of 0.34 W, because that the thermal conductivity for invar is lower than for Ta. As a result of the larger thickness of the bands, the larger product of specific heat and specific weight and also the less favourable variation of the resistance as a function of the temperature, the warm-up time has increased by approximately 75% compared with the above-described construction with Ta bands. In still another embodiment having Ti bands in a thickness of 25 μm the power to be supplied to the heating element required for the operating temperature is 0.27 watt and the warm-up time is again 1.2 seconds. For Ti it is known that the electric resistance increases when oxygen is dissolved in the lattice and during the life the resistance of said bands might increase as a result of oxygen diffusion from the base to the bands. From experiments in which, after the normal activation procedure, the base temperature was adjusted at 750° C. so that the oxygen diffusion rate is approximately a factor 10 larger than at the normal base temperature of 700° C., it was found that after 500 hours the resistance of the system (measured between 24 and 25) had not increased.

Figure 6:
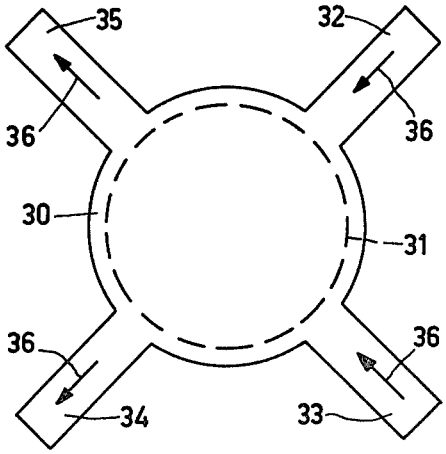
FIG. 6 is a plan view of still another embodiment of a directly heated oxide cathode in accordance with the invention.

FIG. 6 is a plan view of another embodiment of a cathode in accordance with the invention. An emissive layer 31 of BaO and SrO is again provided on the Ti base 31 which has a diameter of 1.3 mm. Four thin metal bands 32, 33, 34 and 35 which together form the heating element and the suspension of the base extend from the base. The angles between the bands are preferably 90°. The current passage may take place in the manner indicated in the Figure by means of arrows 36. The construction is very simple to manufacture when the bands 32, 33, 34 and 35 also consist of Ti. The assembly of base and bands may then be punched from sheet material. Because in this embodiment the edge of 0.2 mm height at the base 20 shown in FIG. 3 is superfluous, a warm-up time of 1.2 seconds can be realized with a material thickness of 25 μm with a steady power of only 0.22 watt supplied to the cathode. Microphony tests in which the angle between the bands and the plane of the base is varied between 30° and 60° have demonstrated that the cathode according to this embodiment is extremely stable and substantially no microphony occurs.

Figure 7:
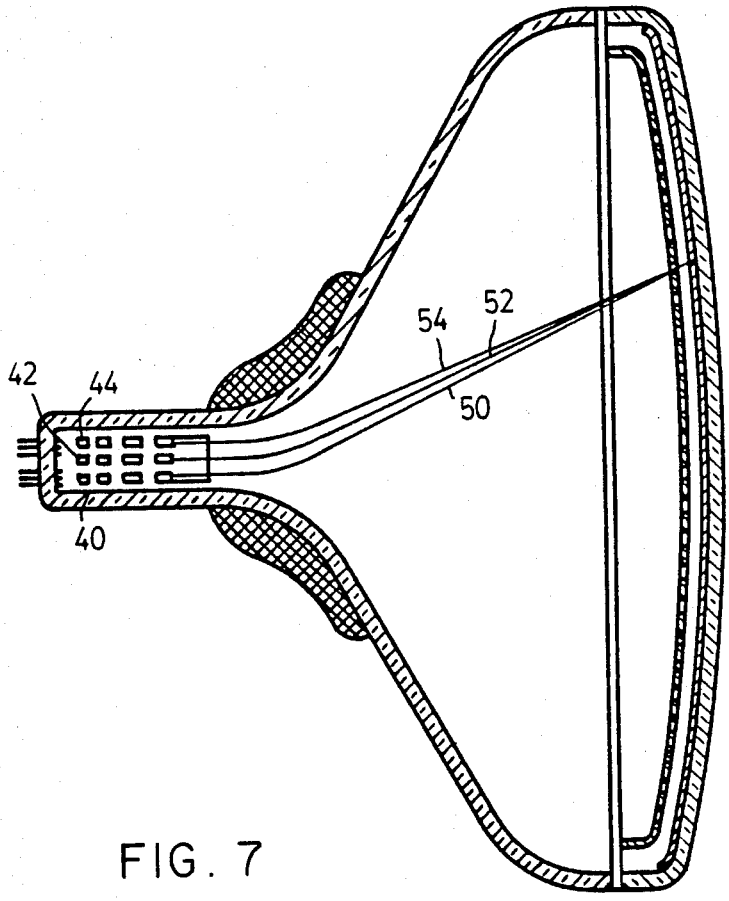
FIG. 7 is a sectional view of a cathode ray tube including a cathode according to the invention.

FIG. 7 schematically illustrates the placement of three cathodes 40, 42, 44 in accordance with the invention, in a cathode ray tube utilizing three electron beams 50, 52, 54 for producing a color picture.

Of course all kinds of variations of the construction shown in FIG. 6 are possible. For example, three bands instead of four may be used. In order to obtain a good temperature distribution two narrow bands which are electrically parallel must be used with the same thickness of the bands, while the third band is approximately twice as wide as one of the narrow bands. In a cathode in accordance with the invention it is not necessary to connect the bands to the circumference of the base.

What is claimed is:

1. An oxide cathode comprising a metal base, a heating element for heating said base, and a porous layer comprising an alkaline earth metal oxide provided on said base, characterized in that the base consists essentially of titanium (Ti).

2. An oxide cathode as claimed in claim 1, characterized in that the heating element is electrically insulated from the base by means of a layer of yttrium oxide ($Y_2O_3$).

3. An oxide cathode as claimed in claim 1, characterized in that the heating element comprises two substantially L-shaped thin metal bands each having a short and a long strip-shaped portion which bands are connected to the base with the end of the short strip-shaped portion and the longitudinal axes of the long strip-shaped portions extend substantially parallel to the surface of the base, said axes enclosing an angle between 30° and 120° between each other, said bands also serving as means for suspending the oxide cathode.

4. An oxide cathode as claimed in claim 1, characterized in that the heating element comprises four thin metal bands extending from the base, two serving to receive and two serving to carry off the electric current for the heating, said bands also serving as means for suspending of the cathode.

* * * * *